US012129609B1

(12) United States Patent
Chen

(10) Patent No.: US 12,129,609 B1
(45) Date of Patent: Oct. 29, 2024

(54) PORTABLE OUTDOOR FLOOR WITH FIXING DEVICE

(71) Applicant: Yiwu Chengshen Technology Co., Ltd., Yiwu (CN)

(72) Inventor: Zuxing Chen, Yiwu (CN)

(73) Assignee: Yiwu Chengshen Technology Co., Ltd., Yiwu (CN)

( * ) Notice: Subject to any disclaimer, the term of this patent is extended or adjusted under 35 U.S.C. 154(b) by 0 days.

(21) Appl. No.: 18/651,135

(22) Filed: Apr. 30, 2024

(30) Foreign Application Priority Data

Apr. 24, 2024 (CN) ..... 202420861780.8

(51) Int. Cl.
*E01C 9/08* (2006.01)
*E01C 5/20* (2006.01)

(52) U.S. Cl.
CPC ..... *E01C 9/086* (2013.01); *E01C 5/20* (2013.01)

(58) Field of Classification Search
CPC ..... E01C 5/20; E01C 9/086
USPC ..... 404/34–46
See application file for complete search history.

(56) References Cited

U.S. PATENT DOCUMENTS 3,775,918 A * 12/1973 Johnson ..... E01C 3/006 404/34
4,963,054 A * 10/1990 Hayashi ..... E01C 5/223 404/34
5,006,011 A * 4/1991 Hiyashi ..... E01C 5/223 52/387
D442,704 S * 5/2001 Lee ..... E01C 9/004 D25/118
6,718,588 B1 * 4/2004 Frederiksen ..... B65G 69/30 404/35
6,718,714 B1 * 4/2004 Montgomery, Sr. ..... F24D 13/022 52/177
7,300,224 B2 * 11/2007 Slater ..... E01C 9/086 404/34
D593,220 S * 5/2009 Reed ..... D25/153
9,206,559 B2 * 12/2015 Bach ..... E01C 5/20
9,770,383 B1 * 9/2017 Meyers ..... E01C 9/00
11,266,562 B1 * 3/2022 Wehmeyer ..... A61H 3/066
2012/0034030 A1 * 2/2012 Smith ..... E01C 5/001 404/34
2018/0271306 A1 * 9/2018 Kong ..... A47G 7/06

* cited by examiner

*Primary Examiner* — Raymond W Addie
(74) *Attorney, Agent, or Firm* — Jeenam Park

(57) ABSTRACT

A portable outdoor floor with a fixing device is provided, which includes a connection base, a fixing member, and a floor, the fixing member is connected to the connection base; the floor is provided on one side of the connection base away from the fixing member. When in use, the connection base is inserted into an outdoor sandy area through the fixing member for fixation. The connection base can provide a certain support force for the floor to avoid tilting. The outdoor floor provided by this technical solution is easy to lay, time-saving and labor-saving; and the floor is made of polypropylene material, which is lightweight and has low transportation costs; furthermore, during transportation and laying, the floor is less prone to damage and cracking.

7 Claims, 7 Drawing Sheets

PORTABLE OUTDOOR FLOOR WITH FIXING DEVICE

CROSS-REFERENCE TO RELATED APPLICATIONS

This application claims priority to Chinese Patent Application No. 202420861780.8, filed on Apr. 24, 2024, which is hereby incorporated by reference in its entirety.

TECHNICAL FIELD

The present disclosure relates to the field of outdoor floor technologies, and in particular, to a portable outdoor floor with a fixing device.

BACKGROUND

Outdoor floor is a type of floor decoration material, usually made of ceramic or marble. Due to the material, existing outdoor floor is heavy, time-consuming and laborious for workers to lay it. In addition, the outdoor floor is heavy during transportation, with high transportation costs, and is prone to damage and cracking during transportation or laying.

SUMMARY

The present disclosure provides a portable outdoor floor with a fixing device so as to address the shortcomings of the prior art.

The technical solution adopted by the present disclosure to solve the above problems is as follows.

The present disclosure provides a portable outdoor floor with a fixing device, including:

- a connection base;
- a fixing member, where the fixing member is connected to the connection base;
- a floor, which is provided on one side of the connection base away from the fixing member.

In an embodiment, there are a plurality of insertion holes uniformly distributed below the connection base, the fixing member is in a shape of conical; at least one set of insertion rods is provided on the fixing member, and the fixing member is detachably connected to the insertion holes on the connection base through the insertion rods.

In an embodiment, the connection base is fixedly connected to the floor.

In an embodiment, a side wall is provided at an edge of the connection base, the side wall extends to upper and lower sides of the connection base to form a floor installation groove and a reinforcing rib connection groove.

In an embodiment, a first reinforcing rib and a second reinforcing rib are provided in the reinforcing rib connection groove; the first reinforcing rib is distributed in a circular shape in the reinforcing rib connection groove, and the second reinforcing rib runs through the first reinforcing rib and is connected to the side wall.

In an embodiment, the insertion holes are distributed on the first reinforcing rib or the second reinforcing rib.

In an embodiment, at least one side of the insertion holes is provided with an opening.

In an embodiment, a plurality of cavities are formed between the first reinforcing rib, the second reinforcing rib, and the side wall, the cavities are provided with a fixing block configured to fix the fixing member, the fixing member is clamped with the fixing block, when storing or transporting the outdoor floor, the fixing member is fixed in the cavities through the fixing block.

In an embodiment, the floor is made of polypropylene.

The beneficial effect of the present disclosure is: the technical solution provides a portable outdoor floor with a fixing device, including a connection base, a fixing member, and a floor, the fixing member is connected to the connection base; the floor is provided on one side of the connection base away from a fixing member. When in use, the connection base is inserted into an outdoor sandy area through the fixing member for fixation. The connection base can provide a certain support force for the floor to avoid tilting. The outdoor floor provided by this technical solution is easy to lay, time-saving and labor-saving; the floor is made of polypropylene material, which is lightweight and has low transportation costs; furthermore, during transportation and laying, the floor is less prone to damage and cracking.

BRIEF DESCRIPTION OF DRAWINGS

In order to provide a clearer explanation of the embodiments of the present disclosure or the technical solutions in the prior art, a brief introduction will be given below to the accompanying drawings required in the description of embodiments or prior art. It is obvious that the accompanying drawings in the following description are only some embodiments of the present disclosure. For those skilled in the art, other accompanying drawings can be obtained based on the structures shown in these drawings without creative work.

Numeral reference: 1—Connection base, 101—Reinforcing rib connection groove, 102—Side wall, 103—First reinforcing rib, 104—Second reinforcing rib, 105—Cavity, 106—Insertion hole, 107—Opening, 108—Fixing block, 2—Fixing member, 201—Insertion rod, 3—Floor, 1*a*—floor installation groove.

DESCRIPTION OF EMBODIMENTS

In order to enable those skilled in the art to better understand the technical solution of the present application, the following will provide a clear and complete description of the technical solution in the embodiments of the present application in combination with the accompanying drawings. Obviously, the described embodiments are only a part of the embodiments of the present application, not all of them. Based on the embodiments in the present disclosure, all other embodiments obtained by those skilled in the art without creative work fall within the protection scope of the present application.

Figure 1:
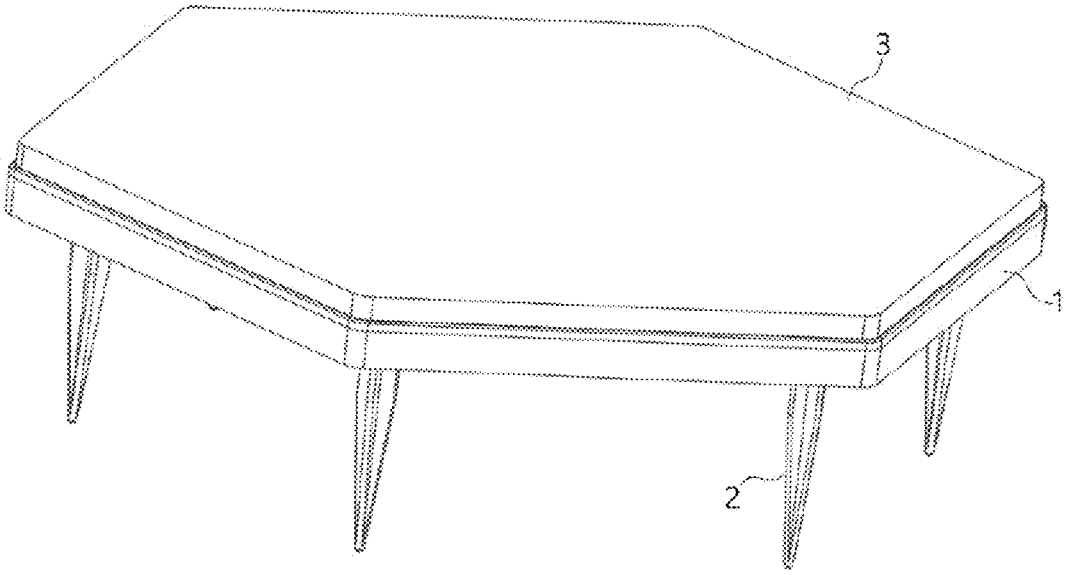
FIG. 1 is a three-dimensional view of a portable outdoor floor with a fixing device of the present disclosure.
Figure 2:
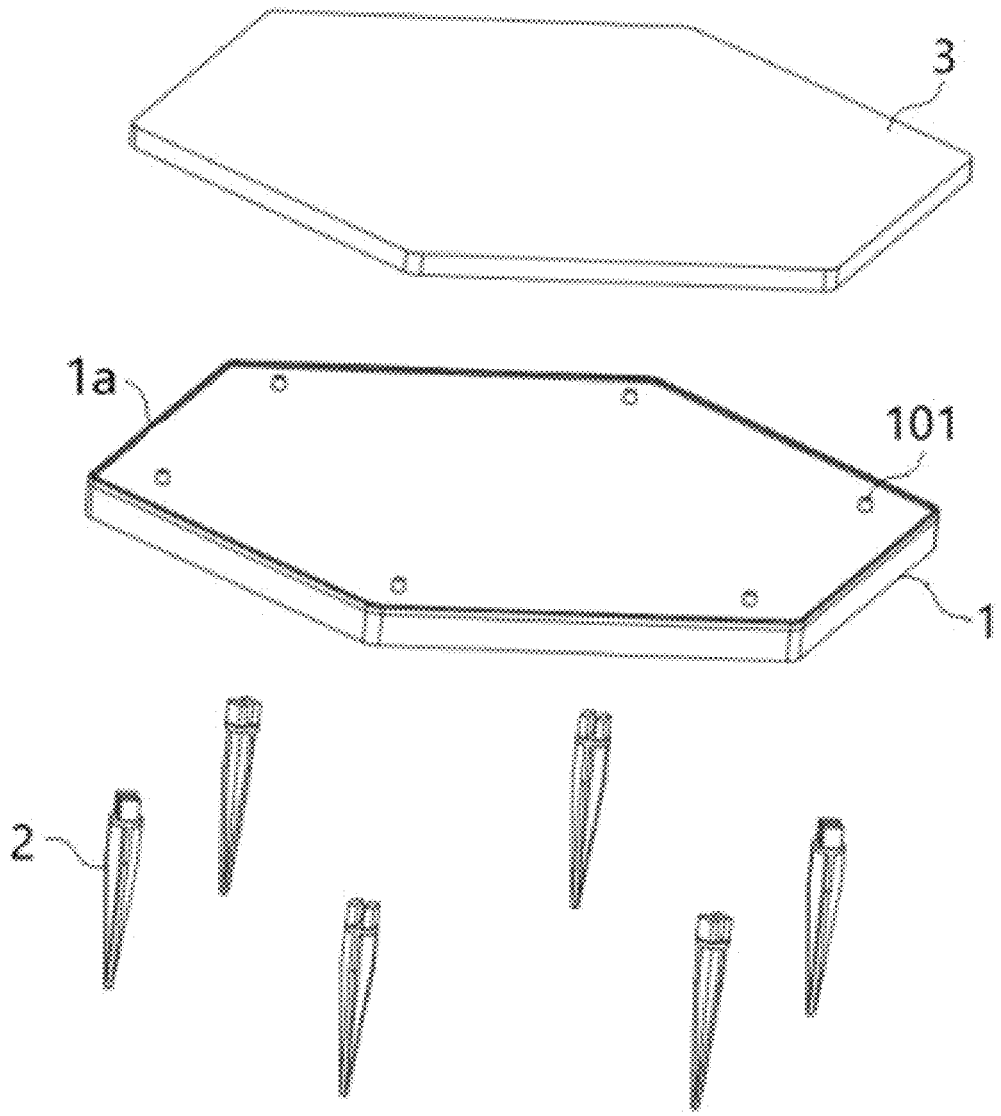
FIG. 2 is an exploded view of FIG. 1 in an unfolding state.
Figure 3:
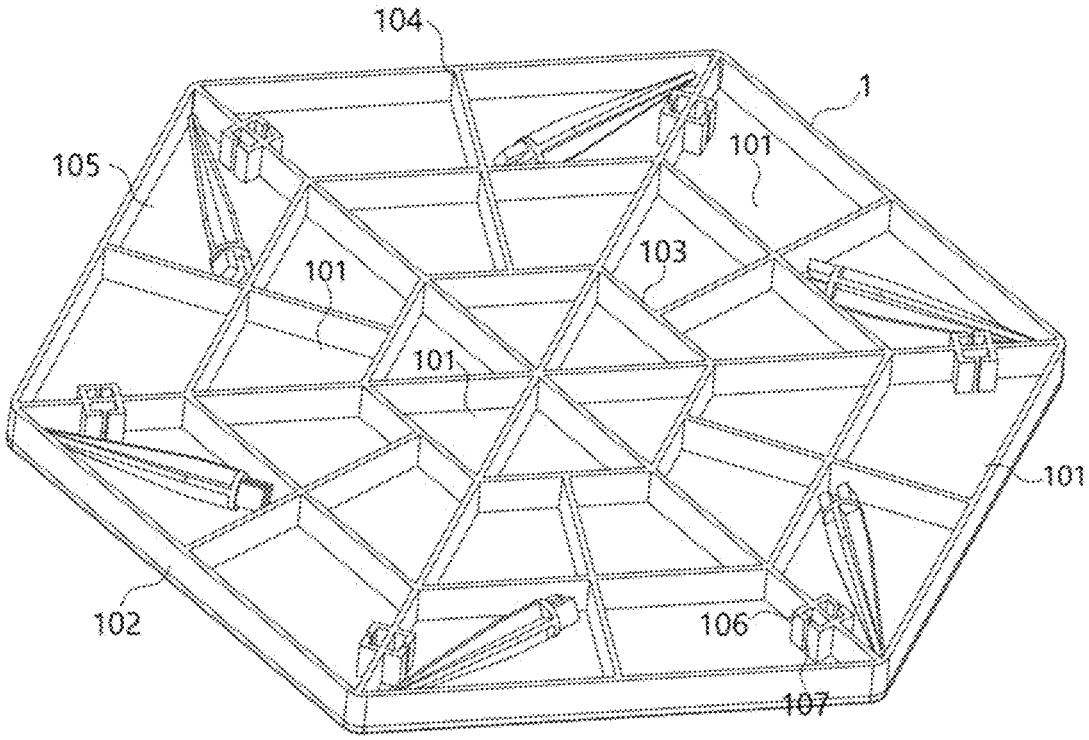
FIG. 3 is a first perspective view of a storage state of the portable outdoor floor with a fixing device of the present disclosure.
Figure 4:
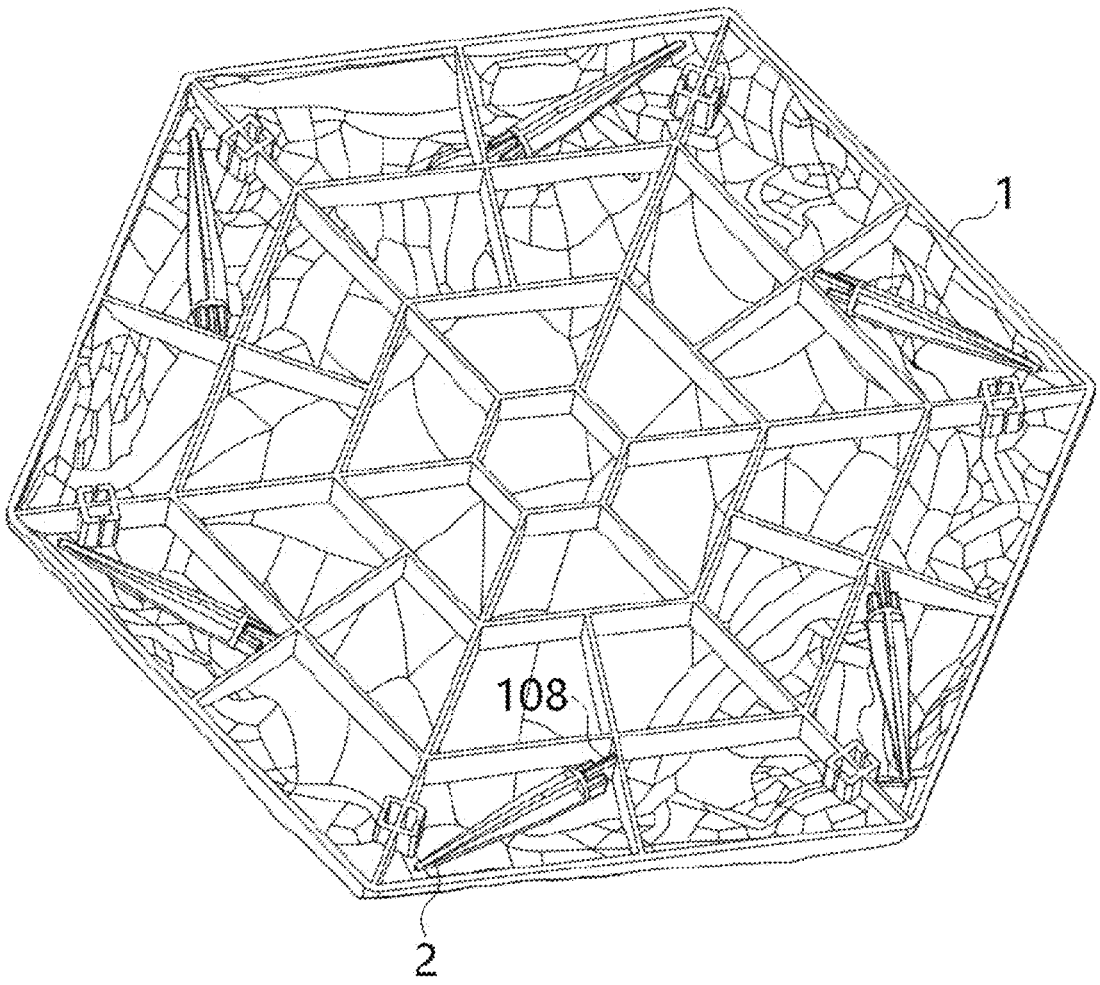
FIG. 4 is a second perspective view of a storage state of the portable outdoor floor with a fixing device of the present disclosure.
Figure 5:
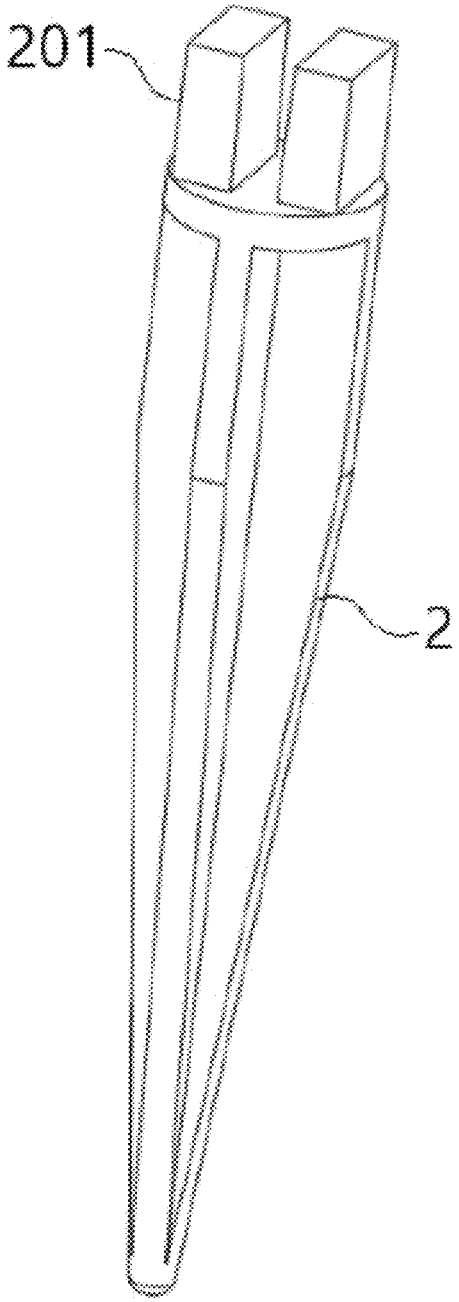
FIG. 5 is a three-dimensional view of a fixing member in the portable outdoor floor with a fixing device of the present disclosure.
Figure 6:
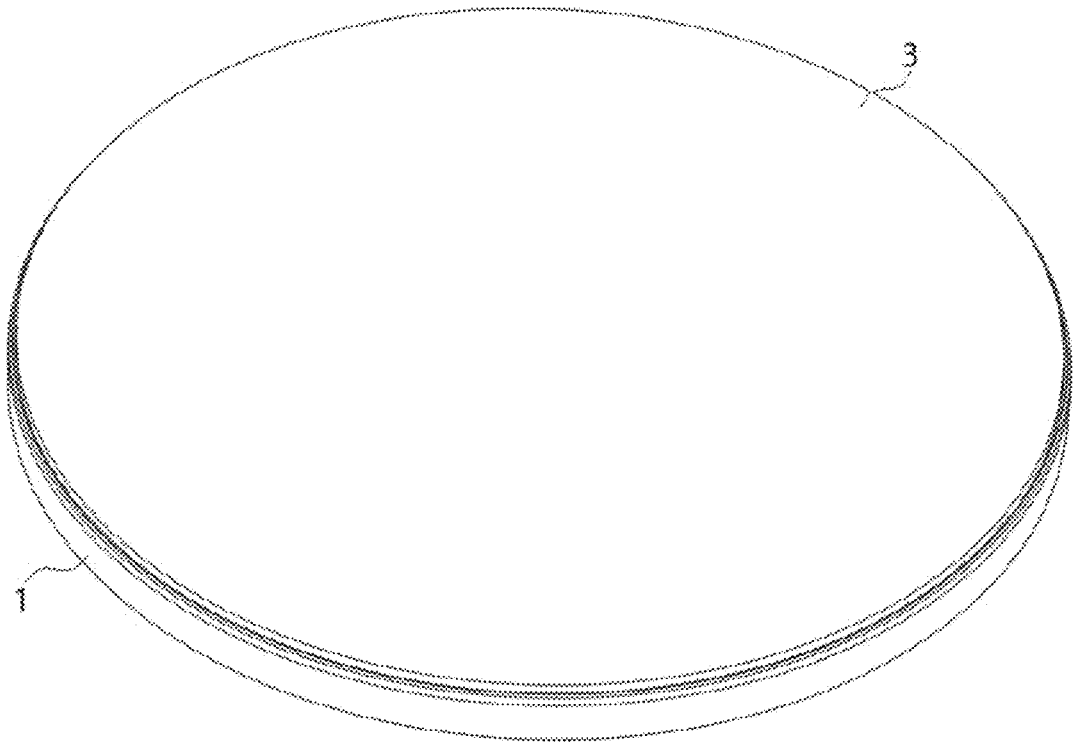
FIG. 6 is a three-dimensional view of a circular floor in the portable outdoor floor with a fixing device of the present disclosure.
Figure 7:
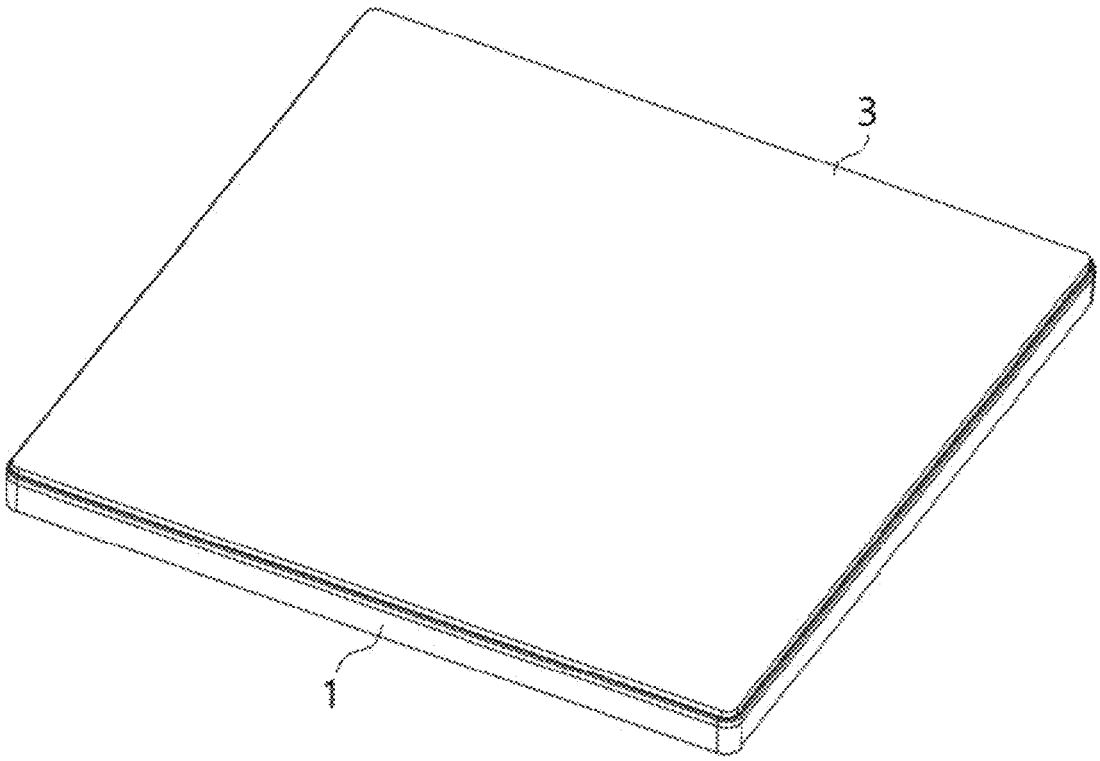
FIG. 7 is a three-dimensional view of a square floor in the portable outdoor floor with a fixing device of the present disclosure.

As shown in FIGS. 1-7 of the specification, this technical solution provides a portable outdoor floor with a fixing device, which includes a connection base 1, a fixing member 2, and a floor 3. The fixing member 2 is connected to the connection base 1; the floor 3 is provided on one side of the connection base 1 far from the fixing member 2. When in use, the connection base 1 is inserted into an outdoor sandy area through the fixing member 2 for fixation. The connection base 1 can provide a certain support force for the floor 3 to avoid tilting of the floor. The outdoor floor provided in this technical solution is easy to lay, time-saving and labor-saving; and the floor is made of polypropylene material, which is lightweight and has low transportation costs; furthermore, during transportation and laying, the floor is less prone to damage and cracking.

In an implementation of this embodiment, there are a plurality of insertion holes 106 uniformly distributed below the connection base 1, and the fixing member 2 is in a shape of "conical". At least one set of insertion rods 201 is provided on the fixing member 2, and the fixing member 2 is detachably connected to the insertion holes 106 on the connection base 1 through the insertion rods 201. When the fixing member 2 is not in use, the fixing member 2 can be removed from the connection base 1, thereby reducing a volume of the outdoor floor.

Specifically, the connection base 1 is fixedly connected to the floor 3.

Specifically, a side wall 102 is provided at an edge of the connection base 1, which extends to upper and lower sides of the connection base 1 to form a floor installation groove 1*a* and a reinforcing rib connection groove 101. The floor installation groove 1*a* can prevent the floor 3 from horizontal displacement and prevent it from detaching from the connection base 1.

In an implementation of this embodiment, the reinforcing rib connection groove 101 is provided with a first reinforcing rib 103 and a second reinforcing rib 104. The first reinforcing rib 103 is distributed in a circular shape in the reinforcing rib connection groove 101, and the second reinforcing rib 104 runs through the first reinforcing rib 103 and is connected to the side wall 102. The first reinforcing rib and second reinforcing rib can enhance an overall strength of the connection base 1 and avoid deformation of the connection base 1.

Specifically, the insertion holes 106 are distributed on the first reinforcing rib 103 or the second reinforcing rib 104, which can enhance a deformation resistance of the insertion holes 106.

Specifically, at least one side of the insertion holes 106 is provided with an opening 107, and a cross-section of the insertion rod 201 is slightly larger than that of the insertion holes 106. The insertion rod 201 is inserted into the insertion holes 106, a side edge of the insertion holes 106 can be unfolded along the opening 107, so that the insertion rod 201 is interference fit with the insertion holes 106, and a connection between the insertion rod 201 and the insertion holes 106 is more secure.

Specifically, a plurality of cavities 105 are formed between the first reinforcing rib 103, the second reinforcing rib 104, and the side wall 102. The cavities 105 are provided with a fixing block 108, the fixing member 2 is clamped with the fixing block 108. When the outdoor floor is stored or transported, the fixing member 2 is fixed in the cavities 105 through the fixing block 108.

In addition, the floor 3 is made of polypropylene, which is not easily affected by sunlight, humidity, and temperature, has a long service life, and is lightweight and easy to handle.

From the above description, it can be seen that the embodiments of the present disclosure achieve the following technical effects:

This technical solution provides a portable outdoor floor with a fixing device, which includes a connection base, a fixing member, and a floor, the fixing member is connected to the connection base, and the floor is provided on one side of the connection base away from the fixing member. When in use, the connection base is inserted into an outdoor sandy area through the fixing member for fixation. The connection base can provide a certain support force for the floor to avoid tilting. The outdoor floor provided by this technical solution is easy to lay, with advantage of time-saving and labor-saving; and the floor is made of polypropylene material, which is lightweight and has low transportation costs; furthermore, during transportation and laying, the floor is less prone to damage and cracking.

It should be noted that terms used here are only for describing specific embodiments and are not intended to limit exemplary embodiments according to the present application. As used here, unless otherwise explicitly stated in the specification, the singular form is also intended to include plural form. In addition, it should be understood that when terms "including" and/or "comprising" are used in this specification, they indicate an existence of features, steps, operations, devices, components, and/or their combinations.

Unless otherwise specified, a relative arrangement, numerical expressions, and numerical values of the components and steps described in these embodiments do not limit the scope of the present application. At the same time, it should be understood that for ease of description, dimensions of each part shown in the attached drawings are not drawn according to an actual proportional relationship. The technology, methods, and equipment known to those skilled in the relevant field may not be discussed in detail, but in an appropriate case, such technology, methods, and equipment should be considered as part of the specification. In all examples shown and discussed here, any specific value should be interpreted as merely illustrative and not as a limitation. Therefore, other examples of exemplary embodiments may have different values. It should be noted that similar labels and letters represent similar terms in the following figures, so once a term is defined in one figure, it does not need to be further discussed in subsequent figures.

In the description of the present application, it should be understood that directional words such as "front", "back", "up", "down", "left", "right", "transverse", "vertical", "longitudinal", "upright", "horizontal", "top" and "bottom" indicate that a directional or positional relationship is usually based on the directional or positional relationship shown in the drawings, only for a convenience of describing the present application and simplifying the description. In the absence of contrary explanations, these directional words do not indicate or imply that the device or component referred to must have a specific orientation or be constructed and operated in a specific orientation, and therefore cannot be understood as a limitation on the protection scope of the present application; in addition, the directional words "inner" and "outer" refer to inner and outer contours relative to each component itself.

It should be understood that when a component is referred to as "on" or "connected to" another component, it can be directly connected to or on that other component, or indirectly connected with an inserted component between the two. On the contrary, when a component is referred to as "directly" on another component or "directly connected" to another component, there is no inserted component between the two.

In addition, it should be noted that in the description of the present disclosure, the use of words such as "first" and "second" to define components is only for a purpose of distinguishing the corresponding components. Unless otherwise stated, the above words do not have special meanings and cannot be understood as limiting the protection scope of the present application. In the description of the present disclosure, unless otherwise specified, the meaning of "multiple" refers to two or more.

The above is a preferred embodiment of the present disclosure. It should be pointed out that for those skilled in the art, several improvements and embellishments can be made without departing from the principles of the present disclosure. These improvements and embellishments are also considered within the protection scope of the present disclosure.

What is claimed is:

1. A portable outdoor floor with a fixing device, comprising:

a connection base;

a fixing member, wherein the fixing member is connected to the connection base;

a floor, which is provided on one side of the connection base away from the fixing member;

wherein a side wall is provided at an edge of the connection base, the side wall extends to upper and lower sides of the connection base to form a floor installation groove and a reinforcing rib connection groove;

wherein a first reinforcing rib and a second reinforcing rib are provided in the reinforcing rib connection groove; the first reinforcing rib is distributed in a circular shape in the reinforcing rib connection groove, and the second reinforcing rib runs through the first reinforcing rib and is connected to the side wall;

wherein a plurality of cavities are formed between the first reinforcing rib, the second reinforcing rib, and the side wall; the cavities are provided with a fixing block configured to fix the fixing member, the fixing member is clamped with the fixing block; when storing or transporting the outdoor floor, the fixing member is fixed in the cavities through the fixing block.

2. The portable outdoor floor with a fixing device according to claim 1, wherein there are a plurality of insertion holes extending through the connection base, the fixing member is in a shape of conical; at least one set of insertion rods is provided on the fixing member, and the fixing member is detachably connected to the insertion holes on the connection base through the insertion rods.

3. The portable outdoor floor with a fixing device according to claim 2, wherein the connection base is fixedly connected to the floor.

4. The portable outdoor floor with a fixing device according to claim 1, wherein the floor is made of polypropylene.

5. The portable outdoor floor with a fixing device according to claim 1, wherein a cross-section of the insertion rod is larger than that of the insertion holes, and the insertion rod is interference fit with the insertion holes.

6. The portable outdoor floor with a fixing device according to claim 1, wherein the insertion holes are distributed on the first reinforcing rib or the second reinforcing rib.

7. The portable outdoor floor with a fixing device according to claim 1, wherein at least one side of the insertion holes is provided with an opening.

* * * * *